US011641889B2

(12) United States Patent
Eldreth

(10) Patent No.: US 11,641,889 B2
(45) Date of Patent: May 9, 2023

(54) ADJUSTABLE MULTI-LAYER BRA

(71) Applicant: Pamela Eldreth, Belcamp, MD (US)

(72) Inventor: Pamela Eldreth, Belcamp, MD (US)

( * ) Notice: Subject to any disclaimer, the term of this patent is extended or adjusted under 35 U.S.C. 154(b) by 132 days.

(21) Appl. No.: 17/025,858

(22) Filed: Sep. 18, 2020

(65) Prior Publication Data

US 2021/0084995 A1 Mar. 25, 2021

Related U.S. Application Data

(60) Provisional application No. 62/969,801, filed on Feb. 4, 2020, provisional application No. 62/903,239, filed on Sep. 20, 2019.

(51) Int. Cl.
*A41C 3/00* (2006.01)
*A41C 3/02* (2006.01)

(52) U.S. Cl.
CPC ..... *A41C 3/02* (2013.01); *A41C 3/0014* (2013.01); *A41C 3/0028* (2013.01); *A41C 3/0057* (2013.01)

(58) Field of Classification Search
None
See application file for complete search history.

(56) References Cited

U.S. PATENT DOCUMENTS 2,346,411 A * 4/1944 Becker ..... A41C 3/00 450/60
3,306,299 A * 2/1967 Paramore ..... A41C 3/0007 450/86
5,873,767 A 2/1999 Pickett
7,435,155 B2 * 10/2008 Reinisch ..... A41C 3/0057 450/59
7,607,966 B1 * 10/2009 Fox ..... A41C 3/0021 450/55
7,806,748 B2 * 10/2010 Richardson ..... A41C 3/02 450/86
7,938,710 B2 * 5/2011 Silverman ..... A41C 3/0021 450/67
8,523,629 B2 9/2013 Pundyk
8,932,103 B2 1/2015 Hansen
9,226,530 B1 * 1/2016 Silverman ..... A41C 3/0057
9,386,807 B2 * 7/2016 Dalton ..... A41F 15/02
9,554,599 B2 * 1/2017 Balland ..... A41C 3/0028
9,578,901 B2 2/2017 Randall et al.
9,788,578 B2 10/2017 Betts
9,839,242 B2 * 12/2017 Yuasa ..... A41C 3/0021
(Continued)

FOREIGN PATENT DOCUMENTS

CN 105167219 A 12/2015
CN 205624532 U 10/2016
CN 106213596 B 3/2018

OTHER PUBLICATIONS

Fair Shade, Karissa Sports Bra, Sep. 25, 2019, 3 pgs., https://www.shopfairshade.com/products/karissa-sports-bra-mauve.

*Primary Examiner* — Jocelyn Bravo
(74) *Attorney, Agent, or Firm* — Moyles IP, LLC

(57) ABSTRACT

An adjustable multi-layer bra includes an inner bra layer, an outer bra layer, and a middle layer that are independently adjustable for positioning and compression of the breasts. The bra includes an inelastic frame to minimize unnecessary compression of the wearer's torso or chest, and adjustment components of the independent bra layers are provided on the front of the bra for ease of use by the wearer.

20 Claims, 8 Drawing Sheets

(56) References Cited

U.S. PATENT DOCUMENTS 10,201,192 B1 2/2019 Lott
10,271,584 B2 4/2019 Ward et al.
10,383,373 B2 * 8/2019 Muhlenfeld ..... A61F 5/02
2006/0252346 A1 * 11/2006 Reinisch ..... A41C 3/0028 450/86
2008/0113587 A1 * 5/2008 Richardson ..... A41C 3/0085 450/86
2010/0022165 A1 * 1/2010 Silverman ..... A41C 3/0021 450/65
2010/0035513 A1 * 2/2010 Jimenez ..... A41C 3/0007 450/80
2010/0210179 A1 * 8/2010 Redenius ..... A41C 3/0021 450/63
2010/0317257 A1 * 12/2010 Campbell ..... A41C 3/0028 450/86
2011/0201252 A1 * 8/2011 Campbell ..... A41C 3/00 450/39
2011/0244757 A1 * 10/2011 Mays ..... A41C 3/0021 450/86
2013/0109276 A1 * 5/2013 Sporn ..... A41C 3/10 450/57
2013/0122780 A1 5/2013 McCall
2014/0256222 A1 9/2014 Silver et al.
2014/0349550 A1 * 11/2014 Campbell ..... A41C 3/0021 450/60
2014/0357158 A1 * 12/2014 Redenius ..... A41C 3/0028 450/60
2015/0011141 A1 * 1/2015 Gasco-Buisson ..... A41C 1/003 450/156
2017/0055602 A1 3/2017 Abraham
2017/0273365 A1 * 9/2017 Muhlenfeld ..... A41C 3/005
2020/0100937 A1 * 4/2020 Patterson ..... A44C 15/005

* cited by examiner

ADJUSTABLE MULTI-LAYER BRA

CROSS-REFERENCE TO RELATED APPLICATIONS

The present application claims the benefit of U.S. Provisional Application No. 62/903,239 filed Sep. 20, 2019 and U.S. Provisional Application No. 62/969,801 filed Feb. 4, 2020, each of which is incorporated herein by reference in its entirety.

BACKGROUND OF THE DISCLOSURE

Compression undergarments such as sports bras are used for a number of reasons to securely position a wearer's breasts and compress the wearer's breasts. Under certain circumstances, for example, in post-operation recovery, during strenuous physical activity, or to shape the bust for a desired physical appearance, compression and restriction of movement of the wearer's breasts is advantageous.

Typical known sports bras may adequately compress and limit movement of a wearer's breasts. However, known sports bras unnecessarily compress or restrict other parts of the wearer's body, such as the torso or the underarms, and impede physical activity, limit the wearer's ability to breathe, or otherwise cause discomfort to the wearer. Often times, the weight of the wearer's breasts is supported by the wearer's shoulders or neck, resulting in fatigue and, at times, chronic pain. Additionally, many known sports bras that are adjustable for purposes of positioning and compressing the breasts require the wearer to adjust clasps, hook and eye closures, or sliders positioned behind the wearer's back or shoulders that are difficult to access by the wearer after the bra has been put on. Such adjustment components are especially inaccessible during use to a wearer that is performing a physical activity or a wearer that is physically incapacitated due to disability or injury.

Accordingly, there is a need for a compression or sports bra that can be adjusted to position and compress the breasts for physical activity without compressing or restricting the wearer's torso, shoulders, or underarms. Additionally, there is a need for an adjustable bra that provides support from non-influenced points on the wearer's back or chest to reduce or alleviate neck and shoulder pain resulting from supporting the weight of the breasts on shoulders/neck. There is also a need for a sports bra that can be easily adjusted during use, for example, by providing means to adjust the bra at locations on the bra that are accessible to the wearer during use.

BRIEF DESCRIPTION

According to an aspect, the exemplary embodiments include an adjustable multi-layer bra including an inner bra layer having a first bra cup including a top edge, a bottom edge, an inner edge, and an outer edge, a second bra cup including a top edge, a bottom edge, an inner edge, and an outer edge, an inner bra bridge connecting the first bra cup inner edge to the second bra cup inner edge, a string path defined along at least one of the first bra cup outer edge, the first bra cup bottom edge, the second bra cup bottom edge, and the second bra cup outer edge, and an adjustment string moveably disposed along the string path. The bra further includes an outer bra layer positioned at least partially over the inner bra layer, where the outer bra layer includes a first shoulder strap and a second shoulder strap. The adjustment string of the inner bra is affixed to the first shoulder strap and the second shoulder strap of the outer bra layer.

According to an aspect, the exemplary embodiments include a multi-layer bra with an inner bra layer including a first bra cup and a second bra cup and a chest band including a first chest band section positioned over the first bra cup and a second chest band section positioned over the second bra cup. The bra includes an outer bra layer having a cross-chest strap extending from a first shoulder strap to a second shoulder strap of the outer bra layer, a first circumferential harness segment extending from the cross-chest strap to a bottom edge of the first chest band section; and a second circumferential harness segment extending from the cross-chest strap to a bottom edge of the second chest band section.

In a further aspect, the exemplary embodiments include a method of using an adjustable multi-layer bra including an inner bra layer, an outer bra layer, and a middle bra layer. The method includes lifting a first bra cup of the inner bra layer by upwardly pulling a first end of an adjustment string extending around an outer edge and bottom edge of the first bra cup and securing the first adjustment string end to a first shoulder strap of the outer layer, and lifting a second bra cup of the inner bra layer by upwardly pulling a second end of the adjustment string extending around an outer edge and a bottom edge of the second bra cup to lift the second bra cup and securing the second adjustment string end to a second shoulder strap of the outer layer. The method further includes compressing the outer bra layer by downwardly pulling an adjustable fastener extending from a cross-chest strap of the outer layer, securing the adjustable fastener to the inner bra layer, and compressing the middle bra layer by tightening a cinching section positioned medially on the middle layer.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1A:
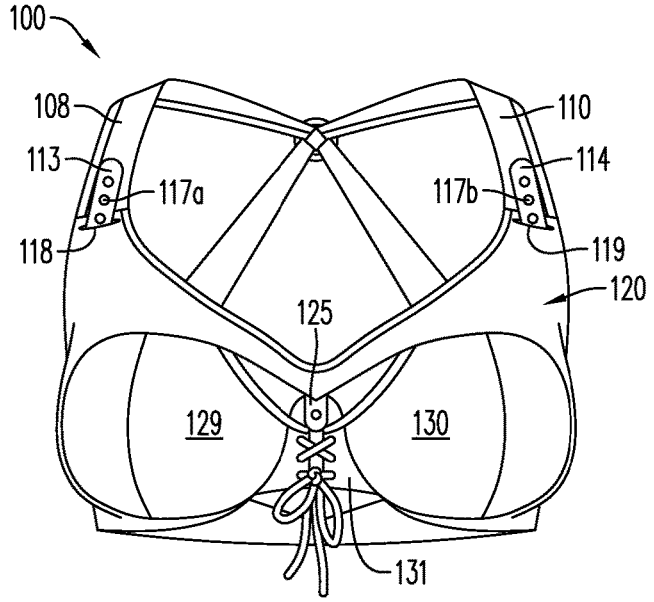
FIG. 1A is a front view of an adjustable multi-layer bra according to an embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

For purposes of this disclosure, "anchored" means securely positioned at a location at which the described component is non-moving or is non-influenced by forces acting on adjacent components. Where the disclosure makes clear that "connected" refers to a purely physical connection or joining, "connected", for purposes of this disclosure, means integrally formed, or securely, separably, or removably joined by known techniques consistent with the disclosure.

Embodiments described herein relate generally to devices and methods of use for an adjustable multi-layer bra. For purposes of this disclosure, the phrases "devices," "systems," and "methods" may be used either individually or in any combination referring without limitation to disclosed components, grouping, arrangements, steps, functions, or processes.

For purposes of illustrating features of the embodiments, an exemplary embodiment will now be introduced and referenced throughout the disclosure. This example is illustrative and not limiting and is provided for illustrating the exemplary features of an adjustable multi-layer bra as described throughout this disclosure.

Turning now to FIG. 1A, a complete multi-layer adjustable bra 100 is shown. The multi-layer adjustable bra 100 includes an inner bra/inner bra layer 101 (shown in FIG. 1B) and an outer bra/outer bra layer 104 (shown in FIG. 1C). The inner bra layer 101 is independently adjustable in relation to the outer bra layer 104 to secure the wearer's breasts at a desired elevation or vertical distance relative to a wearer's shoulders. The inner bra layer 101 includes a first bra cup 102 having a top edge 102*a*, a bottom edge 102*b*, an inner edge 102*c*, and an outer edge 102*d*, and a second bra cup 103 having a top edge 103*a*, a bottom edge 103*b*, an inner edge 103*c*, and an outer edge 103*d*. In the illustrated embodiment, the first bra cup 102 partially encloses and supports a wearer's right breast, and the second bra cup 103 partially encloses and supports the wearer's left breast. The first bra cup 102 and the second bra cup 103 may enclose about three-quarters of the wearer's right and left breast, respectively. According to an aspect, the bra cups 102, 103 of the inner bra layer 101 may be sized and shaped in a manner consistent with standard undergarment measurements (i.e., A, B, C, etc. cup size) for ease of correctly selecting the appropriate bra size by wearers that are familiar with standard undergarment measurements.

Figure 1B:
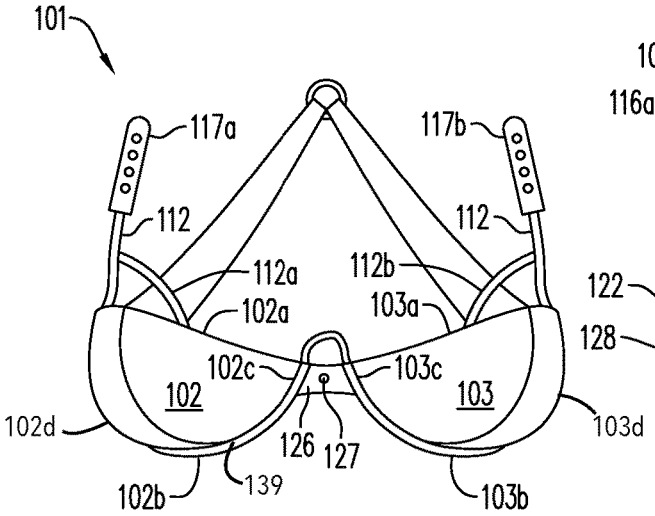
FIG. 1B is a front view of an inner bra layer of the adjustable multi-layer bra according to the embodiment shown in FIG. 1A.

In an embodiment and as shown in FIG. 1A-1B, the inner bra layer 101 includes an adjustment string 112 for independently elevating and securing each breast (i.e., by vertical adjustment of the first bra cup 102 and the second bra cup 103) to a desired position. More particularly, the adjustment string includes a first end 113 and a second end 114 that are configured to be secured to the outer bra layer 104, as will be described further below, adjacent the wearer's right shoulder and left shoulder, respectively. The adjustment string 112 may be moveably disposed in a string path or channel 139 provided along at least a portion of the perimeter of the first bra cup 102 and the second bra cup 103, including at least the bottom edges 102*b*, 103*b*, across the wearer's chest. In an aspect, the string path 139 may be a series of loops or a channel structure through which the adjustment string 112 is threaded. According to an aspect, the adjustment string 112 may be a single, continuous string. In an aspect, the adjustment string 112 may include a first adjustment string moveably disposed along at least a portion of the perimeter of the first bra cup 102, and a second adjustment string moveably disposed along at least a portion of the perimeter of the second bra cup 103. When one or both of the adjustment string first end 113 and the adjustment string second end 114 is pulled upwardly toward the wearer's respective right or left shoulder, the adjustment string 112 lifts the respective first bra cup 102 or second bra cup 103 from the respective bottom edge 102*c*, 103*c* to adjust the vertical position of the wearer's breasts relative to the wearer's shoulders. According to an aspect, the adjustment string 112 functions as part of a pulley system integrated into an inelastic frame defined by the multi-layer bra 100 (described below) to lift and lower the inner bra cups 102, 103. The adjustment string ends 113, 114 may then be fastened to the outer layer 104, as will be described below.

In an embodiment, the adjustment string 112 is moveably disposed in a string path or channel 139 along each of the first bra cup outer edge 102*d*, the first bra cup bottom edge 102*b*, the second bra cup bottom edge 103*b*, and the second bra cup outer edge 103*d*. According to an aspect, the adjustment string 112 is threaded through the channel 139 formed in the inner bra 201 that is provided adjacent at least one of the right bra cup outer edge 102*d*, the right bra cup bottom edge 102*b*, the left bra cup bottom edge 103*b*, and the left bra cup outer edge 103*d*. In an aspect, the adjustment string 112 may be moveably disposed in the inner bra 102 as described above in any manner consistent with this disclosure. The first bra cup 102 and the second bra cup 103 of the inner bra layer 101 are connected by an inner bra bridge 126 that joins the first bra cup inner edge 102*c* and the second bra cup inner edge 103*c*.

According to an embodiment, the adjustment string 112 may include a first adjustment string appendage 112*a* that extends from the adjustment string 112 to the first bra cup top edge 102*a* and a second adjustment string appendage 112*b* that extends from the adjustment string 112 to the second bra cup top edge 103*a*. The first adjustment string appendage 112*a* and the second adjustment string appendage 112*b* secure the respective top edges 102*a*, 103*a* of the first bra cup 102 and second bra cup 103 in the desired position on the wearer's chest. In an aspect, the first adjustment string appendage 112*a* extends from the adjustment string 112 at a point near the adjustment string first end 117*a*, and the second adjustment string appendage 112*b* extends from the adjustment string 112 at a point near the adjustment string second end 117*b*. According to an aspect, the first adjustment string appendage 112*a* and the second adjustment string appendage 112*b* may be made from an elastic material and may measure approximately 2 inches in length.

Figure 1C:
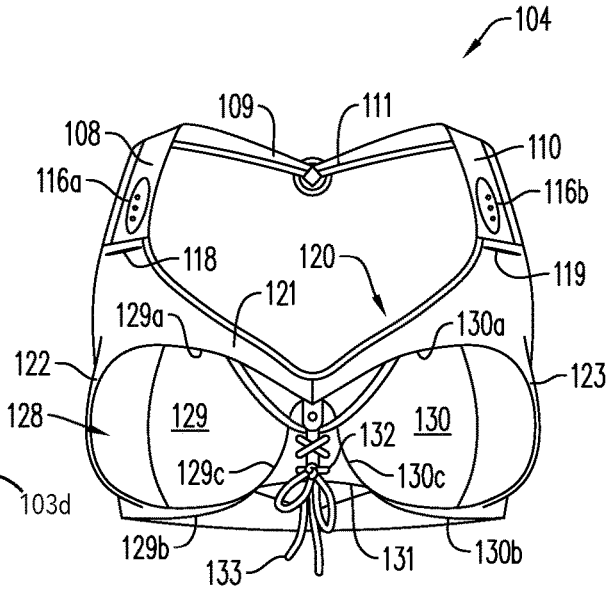
FIG. 1C is a front view of the outer bra layer of the adjustable multi-layer bra according to the embodiment shown in FIG. 1A.

With reference to FIG. 1C, the outer bra layer 104 includes a first shoulder strap 108 with a terminal portion 109 that extends over the wearer's right shoulder and a second shoulder 110 strap with a terminal end 111 that extends over the wearer's left shoulder. In an aspect, the outer bra layer 104 includes a receiver 116*a* positioned on the first shoulder strap 108 and a receiver 116*b* positioned on the second shoulder strap 110. In an assembled configuration as shown in FIG. 1A, the adjustment string first end 113 may be coupled to the to the first shoulder strap 108 and the adjustment string second end 114 may be coupled to the second shoulder strap 110 of the outer bra layer 104. According to an aspect, a first fastener 117*a* provided on the adjustment string first end 113 is coupled to the receiver 116*a*, and a second fastener 117*b* provided on the adjustment string second end 114 is coupled to the receiver 116*b*. According to an aspect, the positioning of the first fastener 117*a* of the adjustment string first end 113 may be adjustable independently of the second fastener 117*b* of the adjustment string second end 114 such that the first bra cup 102 may be secured in a first vertical position and the second bra cup 103 may be secured in a second vertical position depending on the wearer's preference. It is contemplated that in an embodiment, the receivers 116*a*, 116*b* may be positioned on the adjustment string ends 113, 114 and the fasteners 117*a*, 117*b* may be positioned on the shoulder straps 108, 110. In the exemplary embodiment, the receiver 116 and fastener 117 component is a pin and tuck closure in which the receiver 116 is a flat, flexible soft silicone band having a series of holes formed therein for receiving a pin element provided on the fastener 117 that is sized and shaped to be secured in one of the series of holes. While the exemplary embodiments disclosed herein include the pin and tuck closure for securing the adjustment string 112 to the outer bra layer 104, any structure or component consistent with this disclosure may be used for the same purposes. In an aspect, the receiver 116 and fastener 117 component may be provided as any low-profile and/or flexible structure or component consistent with this disclosure to the extent that the fastener and receiver component does not impede comfort of the wearer or usability of the adjustable multi-layer bra 100. For example and not limitation, the receiver 116 and fastener 117 component may be a buckle, a clip, a button, a snap fastener, ties, ratchet straps, or a hook and loop fastener.

In an embodiment as shown in FIGS. 1A and 1C, the first shoulder strap 108 includes a first opening 118 (e.g. a hole, cut, or slit in or extending through the first shoulder strap 108) and the second shoulder strap 110 includes a second opening 119 (e.g. a hole, cut, or slit in or extending through the second shoulder strap 110). The first opening 118 may be positioned adjacent the first receiver 116*a* so that the fastener 117*a* of the adjustment string first end 113 may pass through the first opening 118 to join to the first receiver 116*a*. The second opening 119 may be positioned adjacent the second receiver 116*b* so that the fastener 117*b* of the adjustment string second end 114 may pass through the second opening 119 to join to the second receiver 116*b*.

A chest band 128 extends across the wearer's chest and includes a first chest band section 129 positioned over the first bra cup 102 and a second chest band section 130 positioned over the second bra cup 103. In an aspect, the chest band 128 may be joined to the outer bra layer 104 via tacking along the outer edges of the chest band 128. The chest band 128 may be positioned under the outer bra layer 104, and may overlay the bra cups 102, 103 of the inner bra layer 101. With reference to FIGS. 1C, 3C, and 4C, a first chest band section bottom edge 129*b* is positioned over the first bra cup bottom edge 102*b* and a first chest band section outer edge 129*d* is positioned over the first bra cup outer edge 102*d*. A second chest band section bottom edge 130*b* is positioned over the second bra cup bottom edge 103*b* and a second chest band section outer edge 130*d* is positioned over the second bra cup outer edge 103*d*. In the exemplary embodiment, the bottom edges 102*b*, 103*b*, 129*b*, 130*b* of the bra cups and the chest band are curved to provide a contoured profile. In an aspect, additional fabric may be added to the bottom edges to provide a straight profile extending downward from bottom edges of the bra cups 102, 103 to provide additional coverage for the wearer. In an aspect, an additional layer of fabric (not shown) may be provided over the multi-layer bra 100 to encase and conceal the multiple layers of the bra. The additional layer may be provided, for example and not limitation, as a bandeau, camisole, undershirt, or tank top. The additional layer may be made from a flexible, stretchable fabric or material, and the portion of material overlaying the wearer's breasts may have enhanced stretching functionality to fit the wearer's chest profile when the multi-layer bra 100 is loosened or tightened to varying degrees.

A central chest band section 131 joins the first chest band second 129 and the second chest band section 130 at a medial position on the wearer's chest (e.g., between the wearer's breasts) for tightening and loosening of the chest band 128 and/or the outer bra layer 104. In an embodiment, the central chest band 131 may include a first chest band section inner portion 129*c*, a second chest band section inner portion 130*c*, and a fastening/cinching mechanism for cinching together the first chest band section 129 and the second chest band section 130 to adjust the tension of the chest band 128 and tighten the outer bra layer 104. According to an aspect, the cinching mechanism may include a string 133 threaded between one or more eyelets/grommets 132 positioned in each of the first chest band section inner portion 129*c* and the second chest band section inner portion 130*c*. In other embodiments, the first chest band section 129 and the second chest band section 130 may be constricted or cinched together using any cinching mechanism known or used in the art that is consistent with this disclosure. Alternatively, the central chest band section 131 may comprise a mechanism for adjustably securing the first chest band section inner portion 129*c* to the second chest band section inner portion 130*c*, for example, a buckle, a clip, a button, a snap fastener, ties, ratchet straps, or a hook and loop fastener.

Figure 2A:
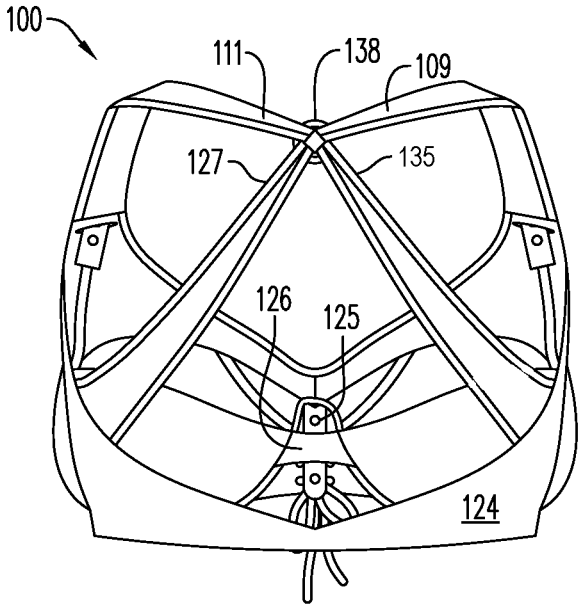
FIG. 2A is a rear view of an adjustable multi-layer bra according to the embodiment shown in FIG. 1A.
Figure 2B:
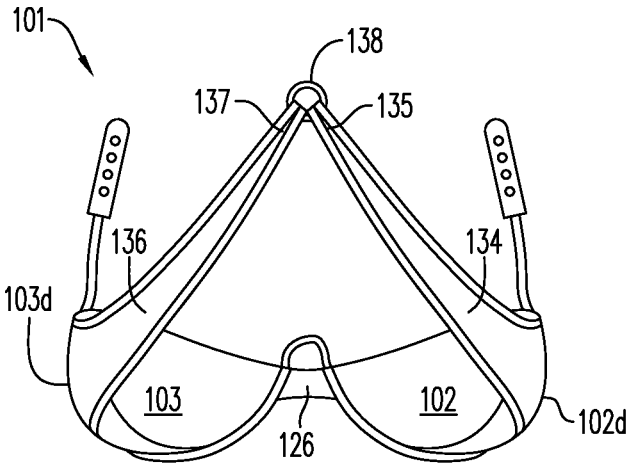
FIG. 2B is a rear view of the inner bra layer of the adjustable multi-layer bra according to the embodiment shown in FIG. 1A.
Figure 2C:
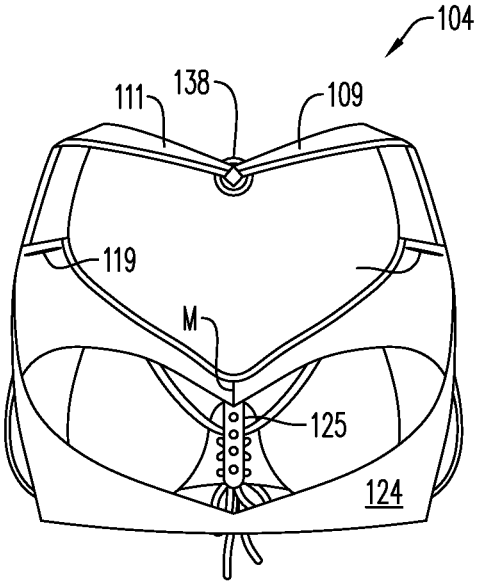
FIG. 2C is a rear view of the outer bra layer of the adjustable multi-layer bra according to the embodiment shown in FIG. 1A.

The outer bra layer 104 includes a chest harness 120 that may partially overlap and join with portions of the chest band 128. The chest harness 120 includes a cross-chest strap 121 extending from the first shoulder strap 108 to the second shoulder strap 110 above the wearer's breasts and below the wearer's clavicle. In an embodiment, the cross-chest strap 121 at least partially covers a portion of a top edge 129*a* of the first chest band section 129 and a portion of a top edge 130*a* of the second chest band section 130. According to an aspect, the cross-chest strap 121 may be joined, for example by tacking, to at least a portion of the top edges 129*a*, 130*a* of the first chest band section 129 and the second chest band section 130. In the exemplary embodiment, the cross-chest strap 121 has a V-shaped profile, however, it is contemplated that the cross-chest strap 121 may be provided in any known neckline, including for example, a scoop neckline or square neckline. As seen in FIG. 2A, an outer bra fastener 125 extends from a midpoint M (see FIG. 7) of the cross-chest strap 121 towards the inner bra bridge 126 for engagement with an inner bra receiver 127 provided on the inner bra bridge 126. According to an aspect, the outer bra fastener 125 and inner bra receiver 127 may be a pin and tuck closure (e.g., such that inner bra receiver 127 is a hole and outer bra fastener 125 includes pins, or vice versa) or any structure or component consistent with this disclosure may be used for the same purposes.

According to an aspect, engagement of the outer bra fastener 125 with the inner bra bridge 126/inner bra receiver 127 connects the inner bra layer 101 to the outer bra layer 104 near the center of the wearer's chest and provides a downward compressive force on the chest harness 120, namely the cross-chest strap 121, that can be increased or decreased by tightening or loosening the engagement of the outer bra fastener 125 to the inner bra receiver 127 as needed by the wearer. The engagement of the outer bra fastener 125 with the inner bra bridge 126 also upwardly urges the bottom edges 102*b*, 103*b* of the inner bra layer 101, thereby supporting the weight of the breasts from the midpoint M of the cross-chest strap 121 rather than the shoulders and/or neck of the wearer, which can alleviate or reduce pain or tension that may result from supporting the weight of the breasts from the shoulders and/or neck.

According to an aspect, the chest harness 120 also includes a first circumferential harness segment 122 (best seen in FIGS. 3A and 3C) extending from the cross-chest strap 121 to the first chest band section bottom edge 129*b* and a second circumferential harness segment 123 (best seen in FIGS. 4A and 4C) extending from the cross-chest strap 121 to the second chest band section bottom edge 130*b*. According to an aspect, the chest harness 120 may be formed of a unitary piece of material and may be non-adjustable. In an embodiment, the first circumferential harness segment 122 may at least partially overlay the first chest band section outer edge 129*d*, and the second circumferential harness segment 123 may at least partially overlay the second chest band section outer edge 130*d*. According to an aspect, each of the first circumferential harness segment 122 and the second circumferential harness segment 123 may be joined, for example by tacking, to the first chest band section outer edge 129*d* and the second chest band section outer edge 130*d*, respectively. The chest harness 120 may be formed from a relatively inflexible fabric or material, so that when the chest band 128 is tightened, the chest harness 120 (including the cross-chest strap 121, the first circumferential harness segment 122, and the second circumferential harness segment 123) is anchored in position on the wearer's body to prevent unwanted movement of the cups 102, 103 and/or the shoulder straps 108, 110.

Figure 3A:
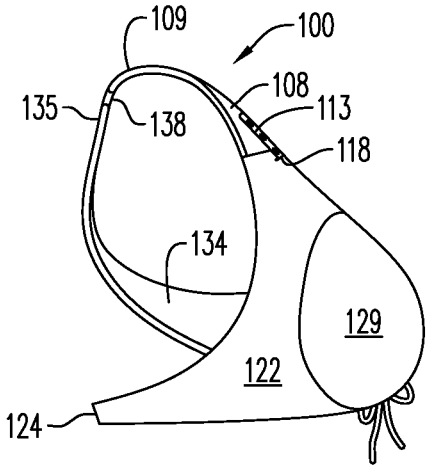
FIG. 3A is a right side view of an adjustable multi-layer bra according to the embodiment shown in FIG. 1A.
Figure 4A:
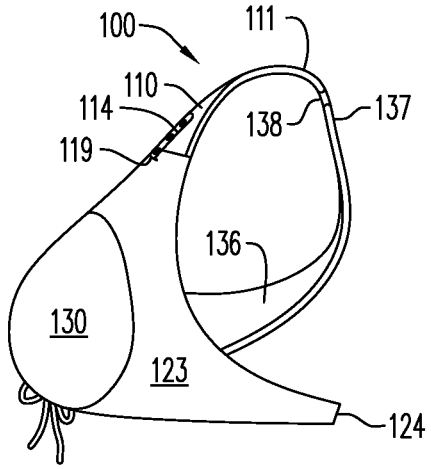
FIG. 4A is a left side view of an adjustable multi-layer bra according to the embodiment shown in FIG. 1A.
Figure 3B:
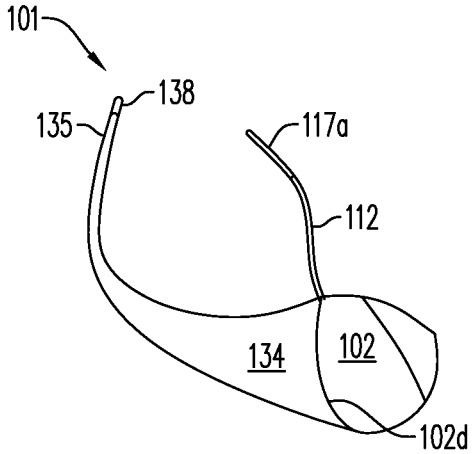
FIG. 3B is a right side view of an inner bra layer of the adjustable multi-layer bra according to the embodiment shown in FIG. 1A.
Figure 4B:
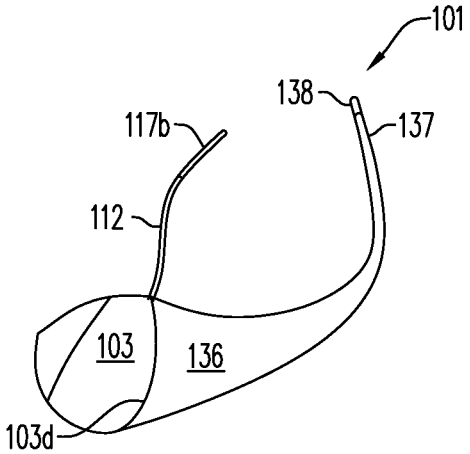
FIG. 4B is a left side view of an inner bra layer of the adjustable multi-layer bra according to the embodiment shown in FIG. 1A.
Figure 3C:
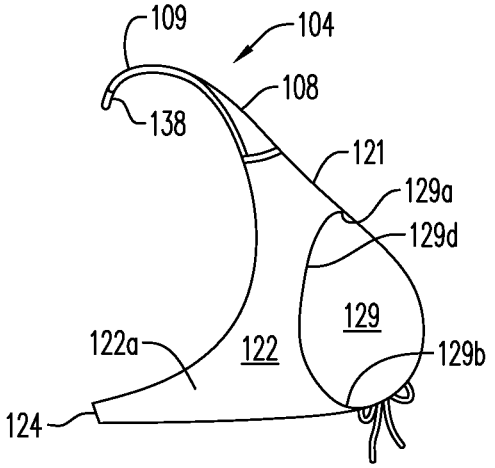
FIG. 3C is a right side view of an outer bra layer of the adjustable multi-layer bra according to the embodiment shown in FIG. 1A.
Figure 4C:
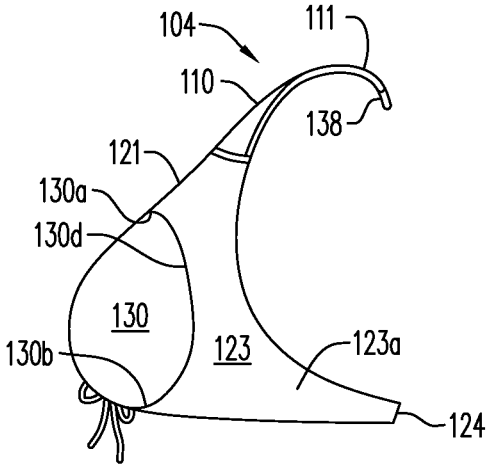
FIG. 4C is a left side view of an outer bra layer of the adjustable multi-layer bra according to the embodiment shown in FIG. 1A.
Figure 5:
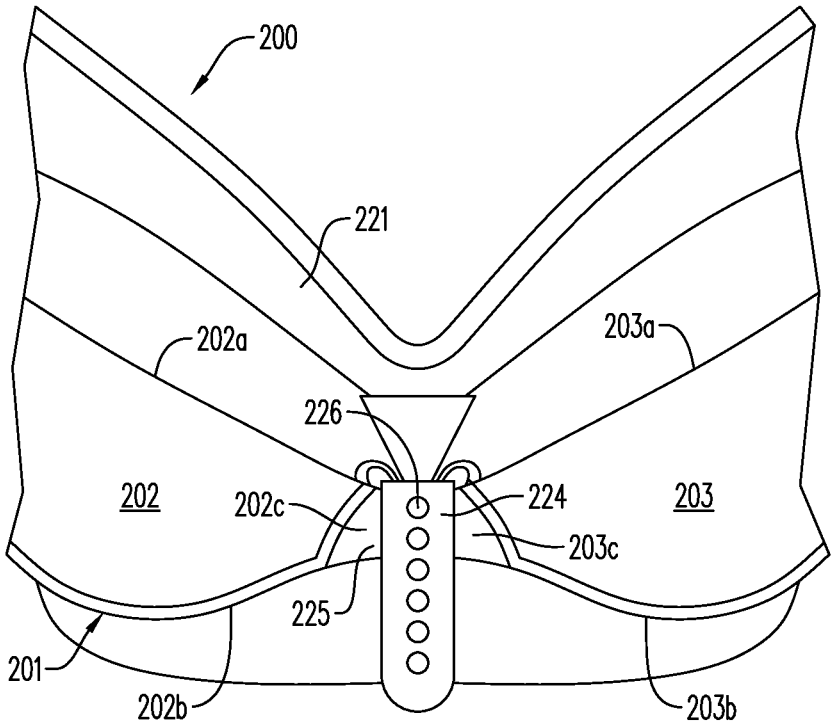
FIGS. 5 and 6 are front views of the adjustable multi-layer bra in a partially assembled configuration according to an embodiment, illustrating inner bra cups, an adjustment string, and an outer bra of the adjustable multi-layer bra according to aspects of the embodiment.
Figure 6:
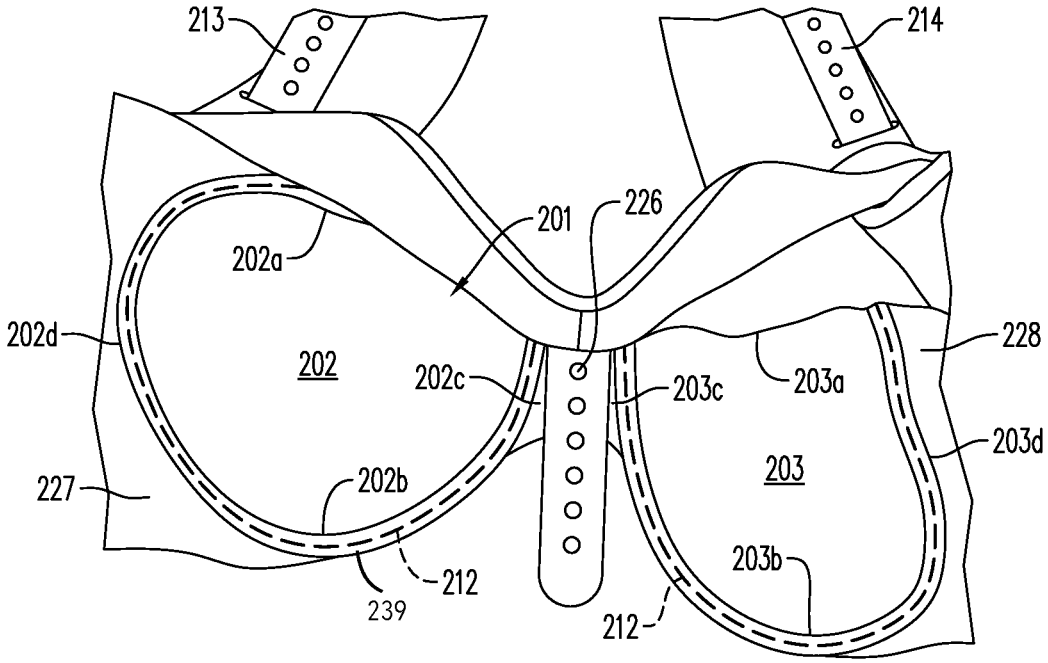

With reference to FIGS. 2A, 3A, and 4A, a horizontal back band 124 extends across the wearer's mid-back from the first circumferential harness segment 122 to the second circumferential harness segment 123. According to an aspect and as illustrated in FIGS. 3C and 4C, the horizontal back band 124 extends from an outer portion 122*a* of the first circumferential harness segment 122 to an outer portion 123*a* of the second circumferential harness segment 123. In an embodiment, the horizontal back band 124 is a relatively inflexible piece of material or fabric that anchors the first circumferential harness segment 122 and the second circumferential harness segment 123 in a desired position. In turn, the circumferential harness segments 122, 123 anchor the chest band 128 and the first and second bra cups 102, 103 such that the bottom edges 102*d*, 103*d*, 129*d*, 130*d* of the first bra cup, second bra cup, first chest band section, and second chest band section are secured under the wearer's breasts.

With reference to FIG. 2, FIGS. 3A-3C, and FIGS. 4A-4C, the inner bra layer 101 includes a first underarm band 134 extending from the outer edge 102*d* of the first bra cup 102 and a second underarm band 136 extending from the outer edge 103*d* of the second bra cup 103. The first underarm band 134 and the second underarm band 136 each extend around a flank/side of the wearer and converge at a point on the wearer's upper back below the nape of the neck. According to an aspect, a clip 138 (e.g., a ring or otherwise) positioned at an upper point on the wearer's upper back/neck base joins a terminal end 135 of the first underarm band 134 and a terminal end 137 of the second underarm band 136. In the exemplary embodiment, the clip 138 also joins the terminal end 109 of the first shoulder strap 108 and the terminal end 111 of the second shoulder strap 110 to provide a single junction point of the inner bra layer 101 and the outer bra layer 104 along the wearer's back.

According to an aspect, components of the adjustable multi-layer bra 100 form an inelastic frame upon which compressive forces acting on the layers of the adjustable multi-layer bra 100 are stabilized. Namely, the right underarm band 134, the left underarm band 134, the right shoulder strap 108, the left shoulder strap 110, the chest harness 120, and the horizontal back band 124 comprise an inelastic frame for adjusting a vertical position and a compressibility of the user's chest. The combination of anchoring by the chest harness 120 with compression by the chest band 128 and by the outer bra fastener 125 prevents unwanted upward movement of the multi-layer bra 100 toward the wearer's shoulders during use. When the wearer adjusts the bra cups 102, 103 of the inner bra layer 101, for example by repositioning the adjustment string 112, the clip 138 defines a pivot point/fulcrum point of the adjustable multi-layer bra 100 from which the inner bra cups 102, 103 are stabilized and from which the positioning of the wearer's breasts can be raised and lowered. This configuration alleviates pressure around the wearer's torso/diaphragm that may otherwise restrict breathing and/or movement during exercise. According to an aspect, the horizontal back band 124 and the chest harness 120 are formed of a material that is relatively inelastic in comparison to the material forming the chest band 128. For example and not limitation, the horizontal back band 124 and the chest harness 120 may be formed from neoprene, and the chest band 128 may be formed of a neoprene-spandex blend of relatively greater elasticity. In an embodiment, during compression of the wearer's chest by adjustment of one or both of the outer bra fastener 125 and the chest band 128, as discussed above, the outer edges 129*d*, 130*d* of the first chest band section 129 and the second chest band section 130 are anchored to the inelastic chest harness 120 and/or the inelastic horizontal back band 124 such that only the cross-chest strap 121 or the chest band 128, and not the horizontal back band 124 or the chest harness 120, is influenced by the increase or decrease of compressive force. This configuration reduces unnecessary compression of the wearer's torso by the horizontal back band 124 or the chest harness 120 during exercise. Conversely, the degree of chest compression can be reduced without loosening the horizontal back band 124. According to an aspect, the horizontal back band 124 is sized to extend snugly around the wearer's back for securing the bottom edges 102*b*, 103*b*, 129*b*, 130*b* of the adjustable multi-layer bra 100 in the desired position under the wearer's breasts.

According to an aspect, with reference to FIGS. 5-10, an exemplary method for using a multi-layer bra 200 having an inner bra layer/inner layer 201, an outer bra layer/outer layer 204, and a middle bra layer/middle layer 218 includes, without limitation, lifting a first bra cup 202 of the inner layer 201 by upwardly pulling a first end 213 of an adjustment string 212 extending around a lateral/outer edge 202*d* and bottom edge 202*b* of the right bra cup 202 and lifting a second bra cup 203 of the inner layer 201 by upwardly pulling a second end 214 of the adjustment string 212 extending around a lateral/outer edge 203*d* and a bottom edge 203*b* of the left bra cup 203 to lift the second bra cup 203. In an embodiment, using the multi-layer bra 200 may include threading the first end 213 of the adjustment string 212 through a first opening 205 on the first shoulder strap 208 and threading the second end 214 of the adjustment string 212 through a second side opening 206 on the second shoulder strap 210, prior to lifting the bra cups 202, 203 or securing the bra cups 202, 203 in the desired position. In an exemplary embodiment and with reference to FIGS. 5-7, the first bra cup 202 includes a top edge 202*a*, a bottom edge 202*b*, a medial/inner edge 202*c*, and a lateral/outer edge 202*d*, and the left bra cup 203 includes a top edge 203*a*, a bottom edge 203*b*, a medial edge 203*c*, and a lateral edge 203*d*. According to an aspect, the respective medial/inner edges 202*c*, 203*c*, of the first bra cup and the second bra cup are joined together and positioned near an anterior midpoint of a wearer's chest. The wearer may use the adjustment string 212, including a first adjustment string end 213 and a second adjustment string end 214, joined to the inner bra layer 201 to independently adjust the inner bra layer 201. According to an aspect, the adjustment string 212 may be retained within the inner bra layer 201, for example and not limitation, the adjustment string 212 may be moveably disposed in a string path or channel 239 along the first bra cup outer edge 202*d*, the first bra cup bottom edge 202*b*, the second bra cup bottom edge 203*b*, and the second bra cup outer edge 203*d*. Alternatively, according to an aspect, the adjustment string 212 may be provided in a fixed position extending from a location on the first outer bra cup 202 and the second outer bra cup 203, for example from a point on the first bra cup top edge 202*a* or outer edge 202*d*, and the second bra cup top edge 203*a* or outer edge 203*d*.

When the first bra cup 202 and the second bra cup 203 are at a desired position, the first end 213 is secured to a first shoulder strap 208 of the outer layer 204 and the second end 214 is secured to a second shoulder strap 210 of the outer layer 204. According to an aspect, securing the first end 213 of the adjustment string 212 to the first shoulder strap 208 is accomplished by attaching a first fastener 217*a* on the first end 213 of the adjustment string 212 to a first receiver 216*a* on the first shoulder strap 208 and securing the second end 214 of the adjustment string 212 is accomplished by attaching a second fastener 217*b* on the second end 214 of the adjustment string 212 to a second side receiver 216*b* on the second shoulder strap 210.

In an aspect of the exemplary embodiment, the outer layer 204 may be adjusted after securing the inner layer 201. The outer bra layer 204 includes a first shoulder strap 208 including a terminal portion 209 extending over a wearer's right shoulder, a first lateral portion 222 including a first lateral portion upper section 222*a* extending from the first shoulder strap 208, a first lateral portion circumferential section 222*b* extending at least partially around the lateral edge of the wearer's first breast, and a first lateral portion bottom edge 222*c*, a second shoulder strap 210 including a terminal portion 211 extending over a wearer's second shoulder, a second lateral portion 223 including a second lateral portion upper section 223*a* extending from the second shoulder strap 210, a second lateral portion circumferential section 223*b* extending partially around the lateral edge of the wearer's second breast, and a second lateral portion bottom edge 223*c*, and a cross-chest strap 221 extending from the first shoulder strap 208 to the second shoulder strap 210.

Further adjusting the multi-layer bra 200 includes compressing the outer layer 204 by downwardly pulling an adjustable fastener 224 extending from a cross-chest strap 221 of the outer layer 204 and securing the adjustable fastener 224 to the inner layer 201. According to an aspect, compressing the outer layer 204 is accomplished by attaching the adjustable fastener 224 to a receiver 226 positioned on a bridge 225 of the inner layer 201 extending from the first bra cup medial edge 202*c* to the second bra cup medial edge 203*c*. The compression of the outer layer 204 may be further adjusted by tightening or loosening the adjustable fastener 224. To adjust the outer bra layer 204, the cross-chest strap 221 is secured downward toward the inner bra layer bottom edges 202*a*, 202*b* by an adjustable fastener 224 extending from a midpoint M of the cross-chest strap 221 along a midpoint of the wearer's chest. An inner layer receiver 226 is formed on a bridge 225 of the inner bra layer 201 that joins the right bra cup medial edge 202*c* and the left bra cup medial edge 203*c*. The inner layer receiver 226 adjustably secures the adjustable fastener 224 to the bridge 225 of the inner bra layer 201. In an embodiment, the adjustable fastener 224 and inner layer receiver 226 components are a pin and tuck closure, or the like, as discussed above with reference to the exemplary embodiment of FIG. 1A-1B.

Figure 7:
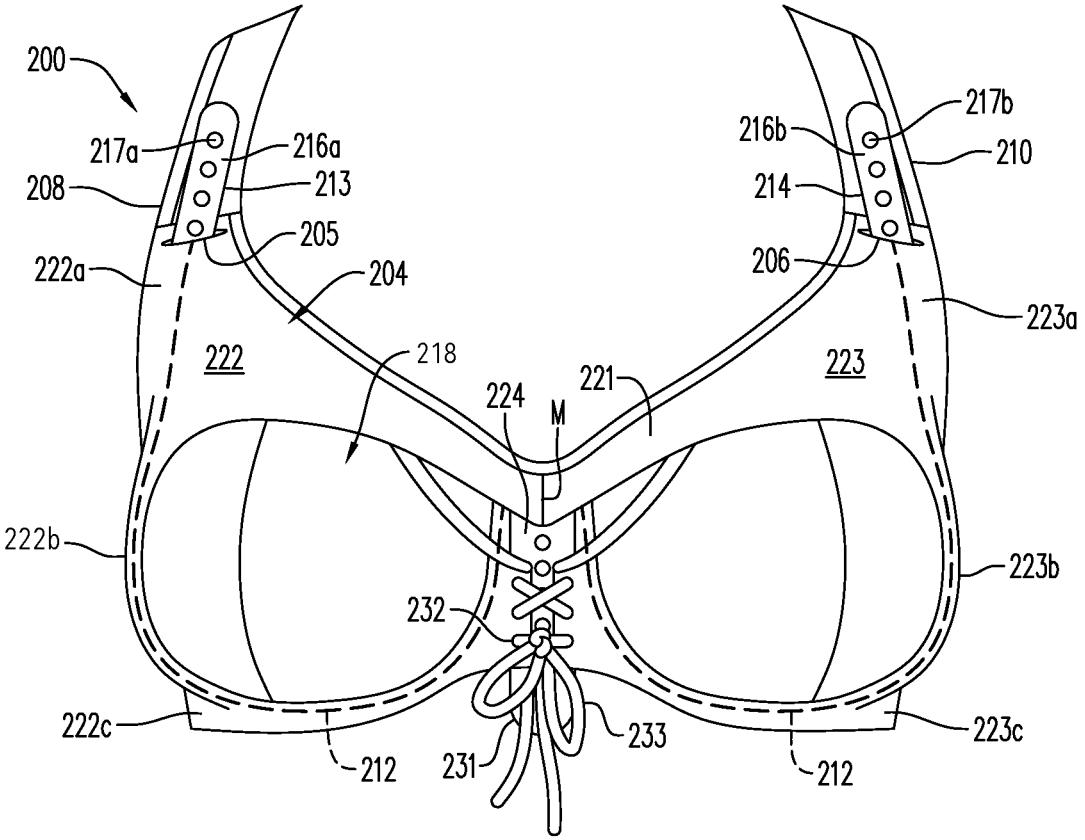
FIG. 7 is a front view of an adjustable multi-layer bra according to an embodiment, illustrating an adjustment string according to an embodiment.
Figure 8:
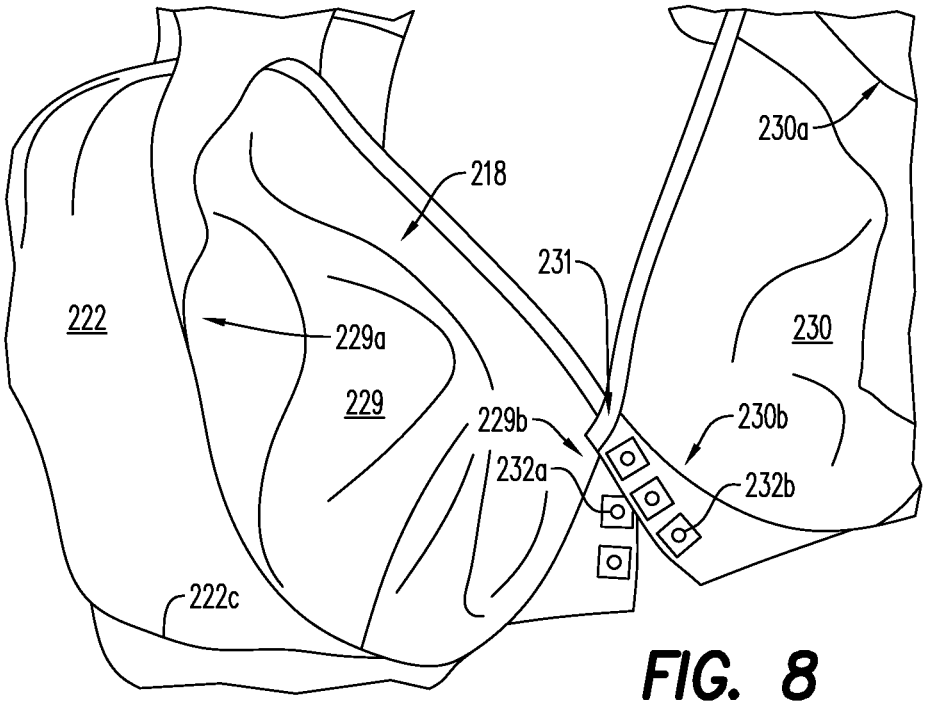
FIG. 8 is a partial front view of an adjustable multi-layer bra according to an embodiment, illustrating an outer bra layer central chest band of the adjustable multi-layer bra according to an aspect of the embodiment.

The adjustable multi-layer bra 200 may also include a middle bra layer/middle layer 218 that is independently adjustable by the wearer, shown in FIGS. 7-8. In an aspect of the exemplary embodiment, the middle layer 218 may be adjusted after compressing the outer layer 204. The middle layer 218 may be compressed by tightening a cinching section 231 provided medially on the middle layer 218. In the exemplary embodiment, compressing the middle layer 218 includes threading a string 233 through at least one grommet 232*a* on a first side/first section 229 of the middle layer 218, threading the string 233 through at least one grommet 232*b* on a second side/second section 230 of the middle layer 218, drawing together the first section 229 and the second section 230 by pulling the string 233, and tying the string 233.

In an aspect, the middle layer 218 extends from a first side of the wearer's chest to a second side of the wearer's chest and is positioned over the inner bra layer 201 and between the inner bra layer 201 and the outer bra layer 204. According to an aspect, the middle layer may be provided between the inner bra layer 201 and the outer bra layer 204. The middle layer 218 includes a cinching section 231 positioned medially near the wearer's midpoint that is used by the wearer to independently adjust the middle layer 218 of the adjustable multi-layer bra 200. In an embodiment, the cinching section 231 joins the first section 229 and the second section 230 that are each attached to the outer bra layer 204. According to an aspect, the first section 229 is joined to a portion of the first circumferential section 222*b* by a lateral end 229*a* of the first section 229, and the second section 230 is joined to a portion of the second circumferential section 223*b* by a lateral end 230*a* of the second section 230.

According to an aspect of the exemplary embodiment, the adjustment components (i.e., the adjustable string 212, the cinching section 231, and the adjustable fastener 224) of the adjustable multi-layer bra 200 are accessible to the wearer on the front of the wearer's body. In other words, the adjustment components are positioned on the adjustable multi-layer bra 200 on the anterior part/front of the bra when in use for ease of access during use.

Figure 9:
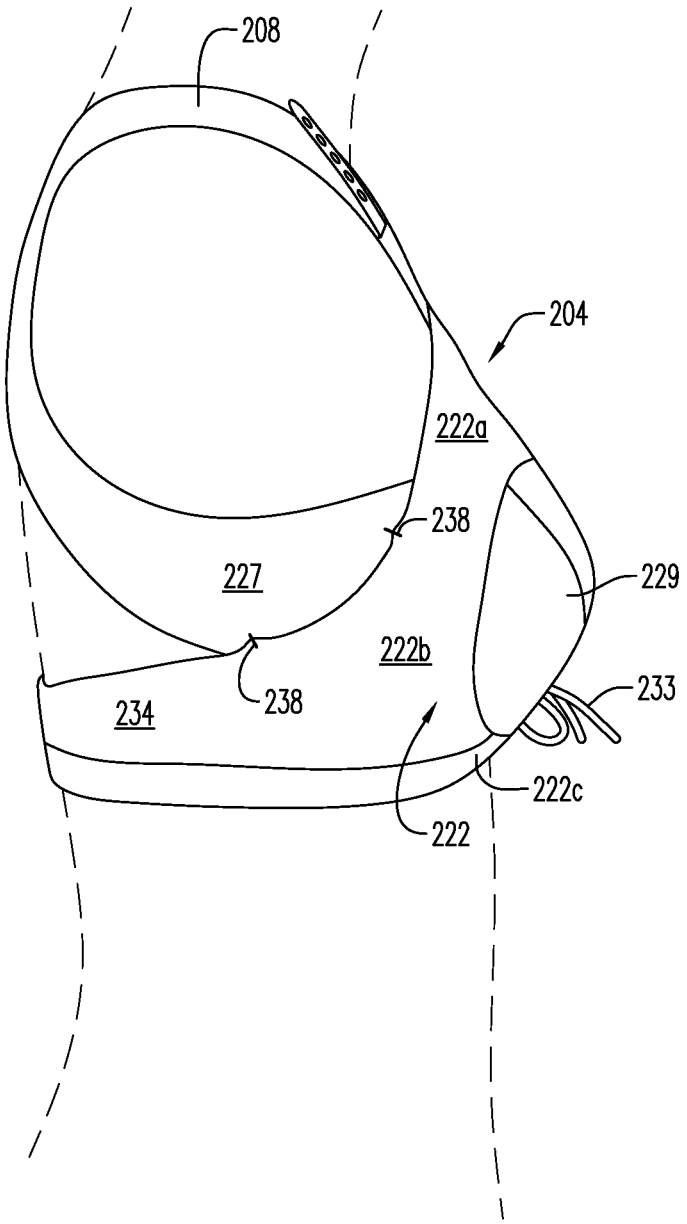
FIG. 9 is a side view of an adjustable multi-layer bra according to an embodiment, illustrating points at which the inner layer bra and the outer layer bra of the adjustable multi-layer bra are connected according to an aspect of the embodiment.
Figure 10:
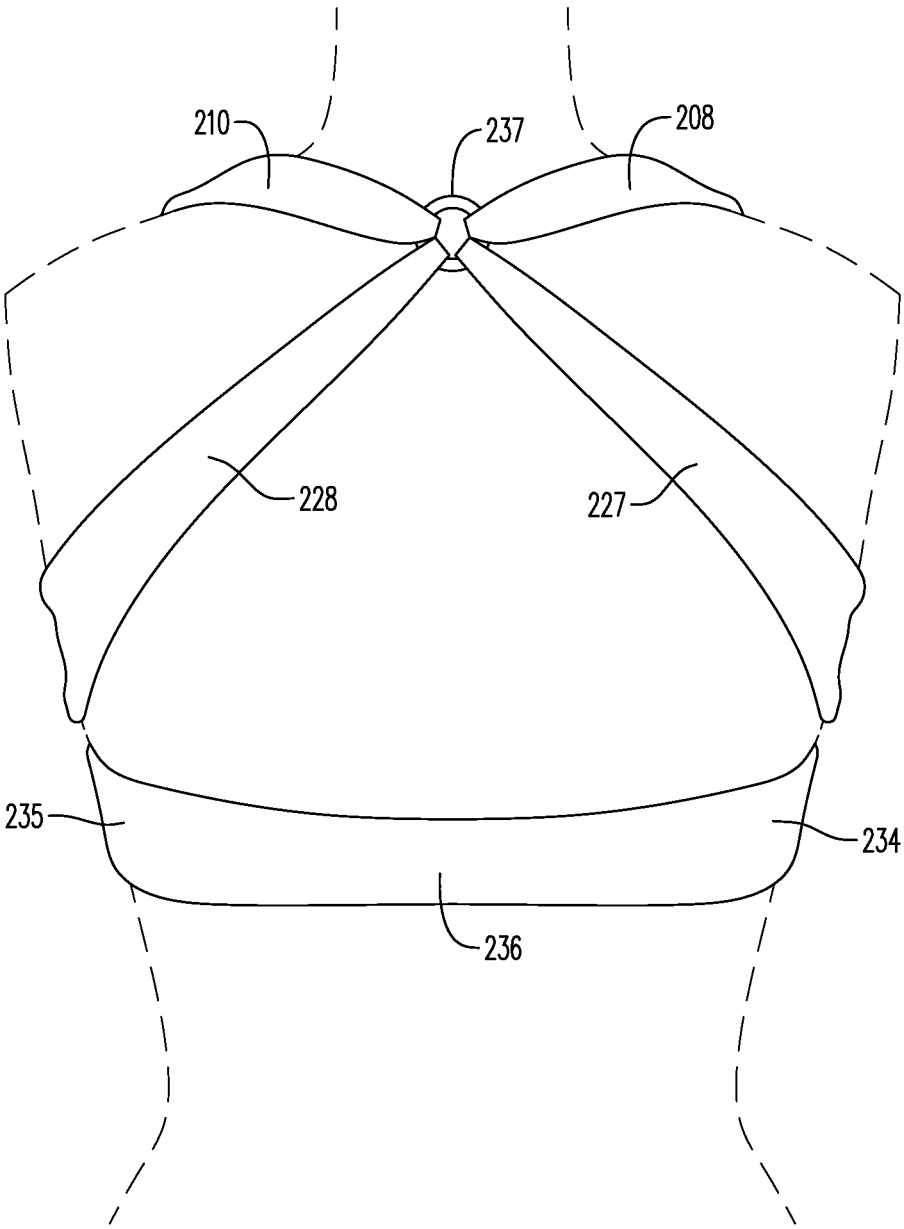
FIG. 10 is a rear view of an adjustable multi-layer bra according to an embodiment, illustrating a clip of the adjustable multi-layer bra positioned at an upper point on a wearer's back according to an aspect of the embodiment.

With reference to FIGS. 9-10, the side and rear of the adjustable multi-layer bra 200 are shown in which portions of the inner layer bra 201 and the outer layer bra 204 extend laterally around the wearer's sides for anchoring the adjustable multi-layer bra 200 on the wearer's body. From the outer bra layer 204, a first wing 234 extending posteriorly from the first circumferential section 222*b*, and a second wing 235 extending posteriorly from the second circumferential section 223*b* join to form a posterior horizontal band 236 across the wearer's back. Portions of the inner layer 201, including a first underarm band 227 extending posteriorly from the first bra cup lateral edge 202*d*, and a second underarm band 228 extending posteriorly from the second bra cup lateral edge 203*d*, join at a point along the wearer's back. In an embodiment, the first shoulder strap 208 and the second shoulder strap 210 of the outer layer bra 204 join with the first underarm band 227 and the second underarm band 228 at the point along the wearer's back. In an embodiment, a clip 237 may be positioned on the wearer's back for joining the first shoulder strap 208, the second shoulder strap 210, the first underarm band 227, and the second underarm band 228. According to an aspect, the clip may be positioned along the nape area of the wearer's back so that the adjustable multi-layer bra 200 is anchored from a non-influenced point on the wearer's body. In an embodiment, and as shown in FIG. 9, the inner layer 201 and the outer layer 204 may be joined together, for example, by lateral side tacking 238 that join the underarm band 227 of the inner layer 201 to the upper section and/or the circumferential section 222*a*/222*b* of the outer layer 204.

Figure 11A:
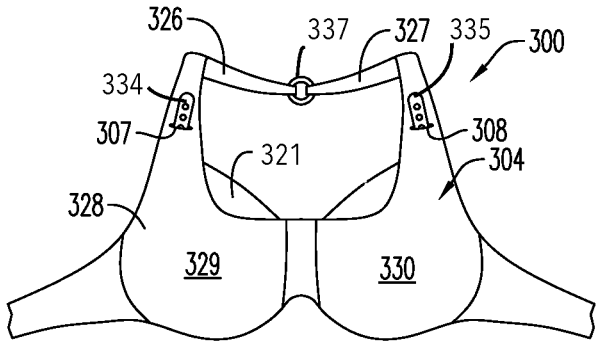
FIG. 11A is a front view of an adjustable multi-layer bra according to an embodiment.
Figure 11B:
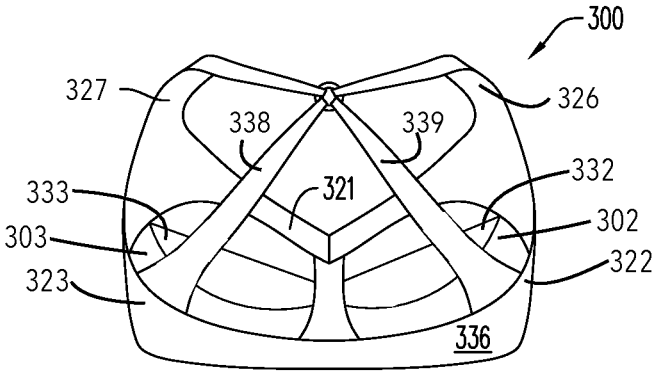
FIG. 11B is a rear view of an adjustable multi-layer bra according to the embodiment shown in FIG. 11A.
Figure 11C:
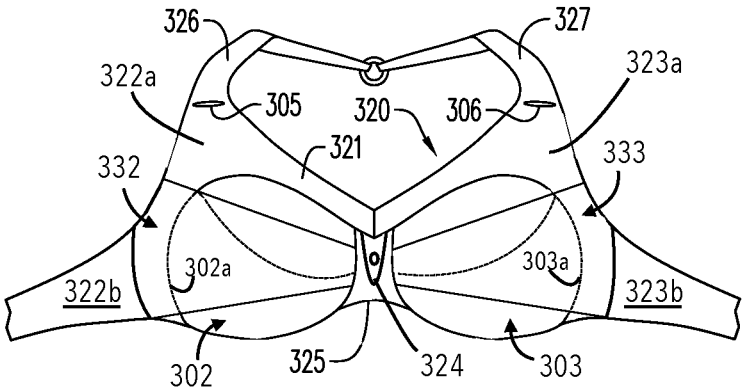
FIG. 11C is a front view of a middle layer of an adjustable multi-layer bra according to the embodiment shown in FIG. 11A.

According to an embodiment of this disclosure shown in FIGS. 11A-11C, a multi-layer bra 300 may include an outer layer 304 that provides coverage of the internal layers for a smooth and solid front profile consisting of a unitary layer of fabric. In an aspect, the outer layer 304 includes a chest band 328 consisting of a first chest band section 329 and a second chest band section 330. A central chest band section 331 is provided between and joins the first chest band section 329 and the second chest band section 330. According to an aspect, the central chest band section 331 is formed from a relatively more elastic material than the material forming the first chest band section 329 and the second chest band section 330 to enable the chest band 328 to fit the wearer's chest profile when the multi-layer bra 300 is loosened or tightened to varying degrees. The chest band 328 may at least partially overlay at least a portion of one or more of a first harness segment 322 (including upper portion 322*a* and circumferential portion 322*b*), a second harness segment 323 (including upper portion 323*a* and circumferential portion 323*b*), and/or the cross-chest strap 321 (FIG. 11C).

With reference to FIG. 11C, the multi-layer bra 300 may include an inner bra comprising a first bra cup 302 and a second bra cup 303 joined by an inner bra bridge 325 provided medially between the first bra cup 302 and second bra cup 303. Similar to the embodiments described above with reference to FIGS. 5-10, an adjustment string may be moveably disposed along one or more edges of the first bra cup 302 and the second bra cup 303 for adjustment of the inner bra cups. According to an aspect, a first opening 305 is formed between the first harness upper portion 322*a* and a first shoulder strap 326, and a second opening 306 is formed between the second harness upper portion 323*a* and a second shoulder strap 327. The outer chest band 328 (FIG. 11A) may at least partially overlay the shoulder straps 326, 327, or alternatively, extend toward the shoulder straps 326, 327 and include respective openings 307, 308 in the outer bra layer 304 (e.g., opening 307 formed in the first chest band section 329 and opening 308 formed in the second chest band section 330) and positioned over the circumferential harness segment openings 305, 306 for passage of the adjustment string ends 334, 335 respectively through the sets of openings 305/307, 306/308. The ends of the adjustment string 334, 335 are fastened to the shoulder straps as discussed above with respect to the embodiment shown in FIGS. 1-3.

In the exemplary embodiment shown in FIGS. 11B and 11C, the first bra cup 302 may be affixed to the circumferential portion 322*b* of the first harness segment 322 at an outer edge 302*a* of the first bra cup, and the second bra cup 303 may be affixed to the circumferential portion 323*b* of the second harness segment 323 at an outer edge 303*a* of the second bra cup 303. A first internal chest band section 332 may extend from the circumferential portion 322*b* to the inner bra bridge 325 and a second internal chest band section 333 may extend from the circumferential portion 323*b* to the inner bra bridge 325. According to an aspect, the first internal chest band section 332 and the second internal chest band section 333 may be affixed to the circumferential portions 322*b*, 323*b* at the same location as the inner bra cups 302, 303, and may be affixed to the inner bra bridge at the same location as the inner bra cups 302, 303. In an aspect, the first internal chest band section 332 and the second internal chest band section 333 may be affixed to an outer surface of the circumferential portions 322*b*, 323*b*, such that the internal chest band sections 332, 333 at least partially overlay circumferential portions 322*b*, 323*b*. Alternatively, the internal chest band sections 332, 333 may be affixed to an interior surface of the circumferential portions 322*b*, 323*b*, such that the circumferential portions 322*b*, 323*b* at least partially overlay the internal chest band section 332, 333. The internal chest band section 332, 333 at least partially overlay a portion of the bra cups 302, 303, respectively.

A cinching mechanism 324 provided adjacent the inner bra bridge 325 may be moveably coupled to each of the first bra cup 302, the second bra cup 303, the first internal chest band section 332, and the second internal chest band section 333 for adjustment thereof by tightening or loosening the cinching mechanism 324. In an aspect, the cinching mechanism 324 is a cord connected to each of the internal edges of the first bra cup 302, the second bra cup 303, the first internal chest band section 332, and the second internal chest band section 333, and can be pulled tight and fastened to control the degree of compression of the bra cups 302, 303 and/or the internal chest band section 332, 333. In an aspect, the internal chest band section 332, 333 comprise a material that is more elastic relative to the material forming the cross-chest strap 321, the first harness segment 322, and the second harness segment 323, such that when the cinching mechanism 324 is tightened, the cross-chest strap 321, the first harness segment 322, and the second harness segment 323 do not compress, and provide an anchoring point from which compression of the bra cups 302, 303 and/or the internal chest band section 332, 333 occurs. In an aspect, the internal chest band sections 332, 333 may together comprise a unitary piece of material extending across the first bra cup 302, the second bra cup 303, and the inner bra bridge 325. In such an embodiment, the material comprising the internal chest band sections 332/333 is affixed to the first circumferential harness portion 322 on a first end and to the second circumferential harness portion 323 on a second end. The cinching mechanisms 324 is connected to a central point of the internal chest band material to tighten or loosen the internal chest band as described hereinabove. The outer bra layer 304 may overlay each of the internal layers (e.g., bra cups 302, 303, internal chest band sections 332, 333, and harness sections 322, 323) as described above with reference to FIG. 11A to conceal the cinching mechanism 324 and internal layers of material.

With reference to FIG. 11B, a horizontal back band 336 of the multi-layer bra 300 extends around the back of the wearer's back as discussed above with reference to FIGS. 5-10. A first underarm band 338 and second underarm band 339 may extend from the back band 336 to connect to a clip 337 at a junction point between the first underarm band 338, the second underarm band 339, the first shoulder strap 326, and the second shoulder strap 327, as described above with reference to FIG. 10. In an embodiment, the horizontal back band 336 may be affixed to each of the first circumferential harness portion 322 and the second circumferential harness portion 323 for extension around the wearer's back.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. An adjustable multi-layer bra, comprising:

an inner bra layer comprising:

a first bra cup including a top edge, a bottom edge, an inner edge, and an outer edge, a second bra cup including a top edge, a bottom edge, an inner edge, and an outer edge, an inner bra bridge connecting the first bra cup inner edge to the second bra cup inner edge, a string path defined along the first bra cup outer edge, the first bra cup bottom edge, the second bra cup bottom edge, and the second bra cup outer edge, an adjustment string moveably disposed along the string path, the adjustment string comprising an adjustment string first end portion extending from the top edge of the first bra cup, and an adjustment string second end portion extending from the top edge of the second bra cup; and an outer bra layer positioned at least partially over the inner bra layer, the outer bra layer comprising:

a first shoulder strap, a second shoulder strap, and a horizontal back band, wherein, when the bra is worn, the first shoulder strap and the second shoulder strap converge at a point on a wearer's upper back that is above the horizontal back band, the first end portion of the adjustment string having a first end configured to be affixed to the first shoulder strap at a position on a front of the bra, and the second end portion of the adjustment string having a second end configured to be affixed to the second shoulder strap at a position on the front of the bra.

2. The adjustable multi-layer bra of claim 1, wherein the first end of the adjustment string is detachably affixed to the first shoulder strap and the second end adjustment string is detachably affixed to the second shoulder strap.

3. The adjustable multi-layer bra of claim 1, wherein:

the adjustment string comprises a first fastener positioned on the first end and a second fastener positioned on the second end;

the outer bra layer comprises a first receiver positioned on the first shoulder strap and a second receiver positioned on the second shoulder strap, and wherein the first fastener of the first end is adjustably secured to the first receiver of the first shoulder strap and the second fastener of the second end is adjustably secured to the second receiver of the second shoulder strap.

4. The adjustable multi-layer bra of claim 3, wherein:

the first end is configured to adjust a vertical position of the first bra cup; and the second end is configured to adjust a vertical position of the second bra cup.

5. The adjustable multi-layer bra of claim 3, the outer bra layer further comprising:

a first opening provided adjacent the first receiver, and a second opening provided adjacent the second receiver, wherein the first end passes through the first opening and the second end passes through the second opening.

6. The adjustable multi-layer bra of claim 3, wherein the first receiver and the first fastener together comprise a first pin and tuck closure, and the second receiver and the second fastener together comprise a second pin and tuck closure.

7. The adjustable multi-layer bra of claim 1, wherein:

the first end is adjustable independently of the second end.

8. The adjustable multi-layer bra of claim 1, wherein:

the first shoulder strap of the outer bra layer includes a terminal portion;

the second shoulder strap of the outer bra layer includes a terminal portion; and the inner bra layer further comprises:

a first underarm band extending from the outer edge of the first bra cup and including a terminal end, and a second underarm band extending from the outer edge of the second bra cup and including a terminal end, wherein the respective terminal ends of each of the first shoulder strap, the second shoulder strap, the first underarm band, and the second underarm band are joined together at a junction point.

9. The adjustable multi-layer bra of claim 8, further comprising:

a clip securing the terminal ends of each of the first shoulder strap, the second shoulder strap, the first underarm band, and the second underarm band to one another at the junction point.

10. A multi-layer bra, comprising:

an inner bra layer including a first bra cup and a second bra cup;

a chest band extending across a front of the bra and including a first chest band section positioned over and being separate from the first bra cup and a second chest band section positioned over and being separate from the second bra cup such that the first bra cup is removably receivable within the first chest band section and the second bra cup is removably receivable within the second chest band section;

an outer bra layer comprising:

a cross-chest strap extending from a first shoulder strap to a second shoulder strap of the outer bra layer;

a first circumferential harness segment extending from the cross-chest strap to a bottom edge of the first bra cup;

a second circumferential harness segment extending from the cross-chest strap to a bottom edge of the second bra cup;

a horizontal back band extending across a back of the bra between an outer edge of the first circumferential harness segment and an outer edge of the second circumferential harness segment; and an adjustment string configured to adjust a vertical position of the first bra cup and the second bra cup, wherein a first end of the adjustment string is configured to be affixed to the first shoulder strap adjacent the first circumferential harness segment at a position on the front of the bra, and a second end of the adjustment string is configured to be affixed to the second shoulder strap adjacent the second circumferential harness segment at a position on the front of the bra.

11. The multi-layer bra of claim 10, wherein:

an outer edge of the first chest band section is joined to the outer edge of the first circumferential harness segment; and an outer edge of the second chest band section is joined to the outer edge of the second circumferential harness segment.

12. The multi-layer bra of claim 11, further comprising:

a central chest band section provided between and joining the first chest band section and the second chest band section; and a cinching mechanism provided on the central chest band section for increasing or decreasing a degree of compression of the chest band.

13. The multi-layer bra of claim 12, wherein:

the central chest band section comprises a first chest band section inner portion joined to the first chest band section and a second chest band section inner portion joined to the second chest band section; and the cinching mechanism comprises one of a buckle, a clip, a button, a snap fastener, fabric ties, ratchet straps, and a hook and loop fastener.

14. The multi-layer bra of claim 11, wherein:

the chest band is formed from a first material;

each of the horizontal back band, the cross-chest strap, the first circumferential harness segment, and the second circumferential harness segment is formed from a second material; and the first material is more elastic relative to the second material.

15. The multi-layer bra of claim 10, further comprising:

an inner bra receiver provided on an inner bra bridge between the first bra cup and the second bra cup; and an outer bra fastener extending from a midpoint of the cross-chest strap towards the inner bra receiver, wherein the outer bra fastener is configured to be secured to the inner bra receiver.

16. The multi-layer bra of claim 15, wherein the inner bra receiver and the outer bra fastener together comprise a pin and tuck closure.

17. The multi-layer bra of claim 10, wherein the chest band comprises:

an outer edge of the first chest band section connected to the outer edge of the first circumferential harness segment; and an outer edge of the second chest band section connected to the outer edge of the second circumferential harness segment.

18. A multi-layer bra, comprising:

an inner bra, comprising:

a first bra cup;

a first underarm band extending from an outer edge of the first bra cup, the first underarm band including a first terminal end;

a second bra cup; and a second underarm band extending from an outer edge of the second bra cup, the second underarm band including a second terminal end, and an outer bra, comprising:

a first shoulder strap having a first terminal portion;

a second shoulder strap having a second terminal portion;

a chest band extending from the first shoulder strap to the second shoulder strap, the chest band being positioned over and being separate from the first and second bra cups such that the first and second bra cups are removably receivable within the chest band; and a horizontal back band, wherein, when the bra is worn, the first terminal portion, the second terminal portion, the first terminal end, and the second terminal end converge at a point on a wearer's upper back that is above the horizontal back band; and wherein an adjustment string connected to each of the first bra cup and the second bra cup is configured to change a vertical position of the first bra cup and the second bra cup relative to the point on the wearer's back through affixation of the adjustment string to the first shoulder strap and the second shoulder strap at a position on a front of the bra.

19. The multi-layer bra of claim 18, wherein:

the inner bra further comprises an inner bra receiver provided on an inner bra bridge between the first bra cup and the second bra cup; and the outer bra further comprises a cross-chest strap extending from the first shoulder strap to the second shoulder strap, and an outer bra fastener extending from the cross-chest strap towards the inner bra receiver, wherein the outer bra fastener is configured to be secured to the inner bra receiver.

20. The multi-layer bra of claim 19, wherein the outer bra further comprises:

a first circumferential harness segment extending from the cross-chest strap to a bottom edge of the first bra cup; and a second circumferential harness segment extending from the cross-chest strap to a bottom edge of the second bra cup, wherein the horizontal back band extends between the first circumferential harness segment and the second circumferential harness segment.

* * * * *